United States Patent [19]

Cartwright

[11] Patent Number: 4,886,560

[45] Date of Patent: Dec. 12, 1989

[54] IGNITION MODIFYING OVERCOAT FOR DETERRENT-COATED SMOKELESS PROPELLANT

[75] Inventor: Richard V. Cartwright, Sussex, N.J.

[73] Assignee: Hercules Incorporated, Wilmington, Del.

[21] Appl. No.: 290,775

[22] Filed: Dec. 28, 1988

[51] Int. Cl.[4] ..... C06B 45/24

[52] U.S. Cl. ..... 149/12; 149/10; 149/49; 149/63; 149/64; 149/76; 149/79; 149/109.6

[58] Field of Search ..... 149/10, 12, 49, 63, 149/64, 76, 79, 109.6

[56] References Cited

U.S. PATENT DOCUMENTS

| | | | |
|---|---|---|---|
| 2,771,035 | 11/1956 | Clark | 102/98 |
| 3,118,797 | 1/1964 | Coffee | 149/10 |
| 3,637,444 | 1/1972 | Bonyata et al. | 149/10 |
| 4,018,637 | 4/1977 | Kimmel et al. | 149/96 |
| 4,089,716 | 5/1978 | Goddard et al. | 149/10 |
| 4,300,961 | 11/1981 | Williams | 149/10 |
| 4,354,884 | 10/1982 | Williams | 149/10 |
| 4,678,524 | 7/1987 | Cranney et al. | 149/21 |

*Primary Examiner*—Stephen J. Lechert, Jr.
*Attorney, Agent, or Firm*—John E. Crowe

[57] ABSTRACT

Method and coating composition for promoting ignition of deterrent-coated smokeless propellant by applying thereto a nitrocellulose-based igniter component as an overcoat.

13 Claims, No Drawings

IGNITION MODIFYING OVERCOAT FOR DETERRENT-COATED SMOKELESS PROPELLANT

The present invention relates to a method for improving the ignition properties of deterrent-coated single or double base smokeless propellant, particularly small-grain gun propellant.

BACKGROUND

Smokeless propellant is conventionally manufactured by dehydrating and granulating wet nitrocellulose, which is then mixed with a solvent or solvent mixtures such as alcohol, acetone, or isopropyl acetate to obtain a dough-like, at least partially gelatinized mixture, which can be further admixed with nitroglycerine to obtain double base propellant. The nitrocellulose/solvent mixture is then conventionally pressed or densified, extruded, cut, dried and screened, as desired, to obtain raw grain propellant. Art-recognized techniques for carrying out the production of smokeless propellant are described in further detail, for instance, in U.S. Pat. Nos. 3,346,675, 2,027,114 and 2,885,736.

Unfinished small grain smokeless propellant has a tendency to fire too rapidly, and initially produce too high a barrel pressure. For this reason, such propellant grains are routinely coated with one or more deterrent compositions such as powdered Vinsol® pine-stump resin*[1], dinitrotoluene, dialkyl and diaryl phthalates, and the like, to slow down the initial firing rate and to maintain a Time/Pressure relation more suitable for ballistic purposes.

*[1]A product of Hercules Incorporated.

Antistatic agents such as powdered graphite are also routinely applied to smokeless propellants as an overcoat to avoid charge accumulation and sparking.

Most deterrent coatings, unfortunately, also have an adverse effect on the ignition properties of smokeless propellants. This on-going problem can sometimes be minimized by admixing both treated (i.e. deterrent- and graphite-coated) and untreated (graphite-coated) propellant grains in precise predetermined ratios, which vary with each batch. Such mixtures are difficult to obtain and maintain until firing, in the absence of ideal mixing and storage conditions.

It is an object of the present invention to improve the ignition properties of deterrent-coated smokeless propellants and to maintain satisfactory burn rates and pressures for ballistics purposes without using complicated mixing and storing procedures.

THE INVENTION

The above object is achieved and the ignition properties and a satisfactory burn rate for deterrent-coated smokeless propellant are obtained by applying to deterrent-coated propellant an effective amount of an igniter component in the form of a composition comprising:

(a) nitrocellulose (NC) base, (b) liquid carrier, (later driven off), (c) up to about 10% and preferably about 2%–6% by dry propellant weight, of at least one inorganic oxidizer component, and (d) a surfactant; and finishing the igniter composition-treated deterrent-coated propellant in a conventional way by drying to remove liquid carrier and drive off volatile components, followed by glazing, screening, and the like as needed to obtain an overcoat comprising an igniter component on the propellant.

The resulting applied and finished igniter component comprises, in combination:

(a) about 20 wt %–90 wt % nitrocellulose base;

(b) surfactant up to an amount sufficient to initially emulsify the nitrocellulose base; and (c) up to about 75 wt % of inorganic oxidizer component.

Nitrocellulose for forming raw smokeless propellant, as earlier described, can be of a conventional single or double base type. Such component is customarily wetted, dehydrated with denatured alcohol, pressed, broken up, masticated with a plasticizer such as nitroglycerine and a solvent such as isopropyl acetate or ethyl alcohol and acetone. The resulting composition is then blocked, extruded, dried, screened, and glazed. The conventional glazing step is further described, for instance, in U.S. Pat. Nos. 3,637,444 and 2,771,035.

For present purposes the applied igniter composition is conveniently prepared from a nitrocellulose (NC) base, preferably one containing about 12% nitrogen. The NC plus a surfactant such as Gafac® RE-610 is dissolved in a solvent such as isopropyl acetate and then combined with water to obtain an emulsion or dispersion containing about 20 wt %–40 wt % of NC.

Up to about 10% (0–10%), inclusive of 0.1%–10% and preferably 2%–6% by dry propellant weight of the inorganic oxidizer is conveniently dissolved or slurried in the NC emulsion or introduced into the igniter composition as part of a subsequently added aqueous diluent. Such inorganic oxidizer component preferably comprises one or more salts examplified by potassium nitrate, sodium nitrate, ammonium nitrate, potassium perchlorate, and ammonium perchlorate.

To assist in distribution of igniter component in an effective amount over the propellant grains, the NC emulsion can conveniently be diluted with water to provide an applicable NC composition content varying from about 10 wt %–30 wt %,.

The finishing step for the igniter composition-treated propellant comprises the steps of drying to substantially remove liquid carrier and volatile components plus the conventional application of an antistatic agent by tumbling the propellant grains with powdered graphite or the like, followed by screening, as needed.

An "effective amount" of igniter component, for purposes of the present invention, constitutes an amount of dry component sufficient to coat about 70% to 100% of available deterrent-coated propellant grains within a batch to a thickness averaging about 0.002 mm to 0.003 mm. or greater.

To apply such coating, it is found that the propellant is preferably tumbled with the above-mentioned emulsion containing oxidizer (e.g. $KNO_3$) and nitrocellulose base.

For purposes of testing the effectiveness of specific igniter components of the instant invention, it is found that suitably ignitable smokeless propellant requires a relatively weak delivered primer charge while, conversely, propellant grains containing a hard-to-fire deterrent coating customarily require a strong delivered primer charge. In addition, the relative strength (or weakness) of the force of a primer blast within a shotgun shell or equivalent shell or cylinder can be conveniently varied, for test purposes, merely by separating a shot gun shell primer and its propellant charge, using stainless steel screens of varying mesh sizes.

The following examples further demonstrate embodiments of the present invention:

EXAMPLE 1

A. Two 4.5 kg batches of Vinsol*1 resin-coated double base smokeless propellant of the BMA (35% NG, 1.60 mm grain diameter and 0.33 mm grain length) and CBP (20% NG, 0.93 mm grain diameter and 0.39 mm grain length) types, hereafter identified as A-1 and A-2, are prepared from 13.25% nitrogen nitrocellulose (NC) which is mixed with nitroglycerine (NG), alcohol and acetone, extruded, cut into the indicated grain length, dried, and deterrent-coated with a dispersion of finely ground Vinsol*1 resin in a conventional manner*3 using a heated (85° C.) mixing drum, then screened, and dried for 24 hours at 55° C. on an open wire mesh tray.

*2A product of GAF Corporation.

*3Reference U.S. Pat. No. 3,637,444.

B. Two 300 gram samples of the glaze-free double base Vinsol deterrent-coated BMA and CBP propellant compositions described in Ex 1A are glazed in a conventional manner, by individually mixing for 1.5 hours with 0.4 wt % of powdered graphite, screened, and set aside as control Samples B-1 and B-2. The remaining unglazed propellant, reported in Ex 1A, is set aside as B-3 for test coating with various test igniter components and glazing.

C. An igniter composition (without oxidizer) is prepared by utilizing diluted emulsion of NC (12% nitrogen) of the RS type. The component is formulated as follows:

430 grams of dry NC plus 76 gms Gafac® RE-610 surfactant*2 is dissolved into 430 grams of isopropyl acetate and 66 gm of Butyl Cellosolve® Acetate*4 and the solution emulsified into 519 grams of water plus 5 gm NaOH at 50° C. The resulting aqueous emulsion, containing about 38% non-volatiles*4A, is then diluted with water to a concentration of 12 wt % NC and utilized as an igniter composition identified as IG-1.

*4A product of Union Carbide Corporation

*4ALess than theoretical due to partial evaporation of solvent.

D. Three igniter compositions prepared containing 2.4 grams NC emulsion, using the procedure of Ex 1C, are mixed with aqueous diluent containing 6 grams of one of the following salts plus 5 grams of water:

Potassium nitrate

Potassium perchlorate and

Ammonium perchlorate.

The resulting igniter compositions are identified as Ig-2, Ig-3 and Ig-4 respectively.

E. Two 300 gm. samples of glaze-free Vinsol-coated double base smokeless propellants described in Example 1A, of the BMA and CBP-types, are individually mixed with 7.4 gm of single base diluted igniter composition Ig-1 (no oxidizer salt) from Example 1C, in a drum mixer for one (1) hour, dried at 55° C. for 24 hours, glazed with 0.4 wt. % of powdered graphite and then screened, in a conventional manner to obtain two batches of overcoated double base propellant. The resulting propellant is used as test propellant charges in 12 gage shot gun shell casings described in Example 2 below.

F. 300 gm samples of glaze-free Vinsol-coated propellant from Example 1A are individually admixed with oxidizer salt-containing igniter components obtained in accordance with Example 1D (listed as Ig-2, Ig-3 and Ig-4) and finished in a manner identical to Example 1E to obtain glazed test propellant charges for use in packing 12 gage shotgun shell casings and testing as described in Example 2 below.

EXAMPLE 2

Twenty-seven 12 gage 2.75" integral-base-wad type shot gun shell casings are individually charged with the same type Federal 12 gage primer, followed, in sequence, by a closely fitted 0.25" (6.35 mm) long cylindrical-shaped stainless steel spacer having a circular center hole of 7.94 mm diameter arranged parallel to the long axis of each casing and covered by a stainless steel screen of 44, 60, or 80 mesh, respectively, to vary the delivered force of substantially identical fired primer charges. On the opposite side of each screen is placed a measured propellant charge of a control- or an igniter-coated test propellant described in Examples 1B, 1C, 1D, 1E or 1F. The charge weight employed for each control batch is pre-determined to obtain a base charge weight for each batch (i.e. the amount of propellant required to generate an average peak firing pressure within the range of 10,000–12,000 psi with a 44 mesh screen interposed across the spacer window). The appropriate charge weight, so determined, is utilized in each test shotgun shell casing employing the same propellant batch, using screens 44, 60 and 80 mesh in the respective test shell spacers.

The resulting test shells are end packed with identical RXP-12S wads and 43 grams of #6 lead shot, crimped using a 6 point MEC crimp, and test fired in an identical manner to determine peak pressures and muzzle velocities, using a piezoelectric gage*5 and multiple electronic screens*6 arranged perpendicular to the shot path in a conventional manner. Test results are reported in Tables 1 and 2 below.

*5Model 167A made by Piezotronics.

*6Oehler System 82

TABLE 1

BALLISTIC PROPERTIES OF OVERCOATED, VINSOL-DETERRED PROPELLANTS

| Example/ Sample - | Propellant Type | Igniter Component Overcoating | Propellant Charge wt. (grains) | Shell spacer Screen (mesh) | Peak pressure, psi Av | n(a) | Muzzle velocity, ft/s Average | n(a) |
|---|---|---|---|---|---|---|---|---|
| 1B/B-1 | BMA | None (control) | 44.5 | 44 | 11790 | 5 | 1422 | 5 |
| | BMA | None (control) | 44.5 | 60 | 7330 | 5 | 1300 | 5 |
| | BMA | None (control) | 44.5 | 80 | 2660 | 2 | 484 | 2 |
| 1E/B-1 | BMA | 0.3% NC | 45.0 | 44 | 11140 | 5 | 1390 | 5 |
| /Ig-1 | BMA | 0.3% NC | 45.0 | 60 | 9780 | 5 | 1364 | 5 |
| | BMA | 0.3% NC | 45.0 | 80 | 5970 | 3 | 779 | 3 |
| 1F/B-3 | BMA | 2% $KNO_3$ + 0.3% NC | 42.0 | 44 | 11360 | 5 | 1360 | 5 |
| /Ig-2 | BMA | 2% $KNO_3$ + 0.3% NC | 42.0 | 60 | 11100 | 5 | 1346 | 5 |
| | BMA | 2% $KNO_3$ + 0.3% NC | 42.0 | 80 | 10980 | 5 | 1346 | 5 |
| 1F/B-3 | BMA | 2% potassium perchlorate + 0.3% NC | 41.0 | 44 | 11850 | 5 | 1399 | 5 |
| /Ig-3 | BMA | 2% potassium perchlorate + 0.3% NC | 41.0 | 60 | 11780 | 5 | 1398 | 5 |

TABLE 1-continued

BALLISTIC PROPERTIES OF OVERCOATED, VINSOL-DETERRED PROPELLANTS

| Example/ Sample - | Propellant Type | Igniter Component Overcoating | Propellant Charge wt. (grains) | Shell spacer Screen (mesh) | Peak pressure, psi Av | n[a] | Muzzle velocity, ft/s Average | n[a] |
|---|---|---|---|---|---|---|---|---|
| | BMA | 2% potassium perchlorate + 0.3% NC | 41.0 | 80 | 11540 | 5 | 1391 | 5 |
| 1F/B-3 | BMA | 2% ammonium perchlorate + 0.3% NC | 41.0 | 44 | 11790 | 5 | 1402 | 5 |
| /lg-4 | BMA | 2% ammonium perchlorate + 0.3% NC | 41.0 | 60 | 11670 | 5 | 1399 | 5 |
| | BMA | 2% ammonium perchlorate + 0.3% NC | 41.0 | 80 | 11550 | 5 | 1396 | 5 |
| 1B/B-2 | CBP | None (control) | 38.5 | 44 | 10740 | 5 | 1588 | 5 |
| | CBP | None (control) | 38.5 | 60 | 4370 | 4 | 1166 | 5 |
| | CBP | None (control) | 38.5 | 80 | 4030 | 3 | 583 | 4 |
| 1E/B-3 | CBP | 2% $KNO_3$ + 0.3% NC | 31.0 | 44 | 11790 | 5 | 1355 | 5 |
| /lg-2 | CBP | 2% $KNO_3$ + 0.3% NC | 31.0 | 60 | 7920 | 5 | 1272 | 5 |
| | CBP | 2% $KNO_3$ + 0.3% NC | 31.0 | 80 | 7270 | 5 | 1242 | 5 |
| 1F/B-3 | CBP | 2% potassium perchlorate + 0.3% NC | 29.0 | 44 | 11180 | 5 | 1459 | 5 |
| /lg-3 | CBP | 2% potassium perchlorate + 0.3% NC | 29.0 | 60 | 9520 | 5 | 1430 | 5 |
| | CBP | 2% potassium perchlorate + 0.3% NC | 29.0 | 80 | 8380 | 5 | 1401 | 5 |
| 1F/B-3 | CBP | 2% ammonium perchlorate + 0.3% NC | 29.5 | 44 | 10740 | 5 | 1465 | 5 |
| /lg-4 | CBP | 2% ammonium perchlorate + 0.3% NC | 29.5 | 60 | 10100 | 5 | 1430 | 5 |
| | CBP | 2% ammonium perchlorate + 0.3% NC | 29.5 | 80 | 7840 | 5 | 1392 | 5 |

[a]Number of shots, out of five, for which a positive value was recorded.

TABLE 2

PRIMER ATTENUATION SENSITIVITY OF OVERCOATED PROPELLANTS

| Example/ Sample | Propellant Type | Igniter Component Overcoating | Shell Spacer Screen (mesh) | $P_s/P_{44}$[b] | $V_sV_{44}$[b] |
|---|---|---|---|---|---|
| 1E/B-1 | BMA | 0.3% NC | 60 | 0.88 | 0.98 |
| /lg-1 | BMA | 0.3% NC | 80 | 0.54 | 0.56 |
| 1F/B-3 | BMA | 2% $KNO_3$ + 0.3% NC | 60 | 0.98 | 0.99 |
| /lg-2 | BMA | 2% $KNO_3$ + 0.3% NC | 80 | 0.97 | 0.99 |
| 1F/B-3 | BMA | 2% potassium perchlorate + 0.3% NC | 60 | 0.99 | 1.00 |
| /lg-3 | BAM | 2% potassium perchlorate + 0.3% NC | 80 | 0.97 | 0.99 |
| 1F/B-3 | BMA | 2% ammonium perchlorate + 0.3% NC | 60 | 0.99 | 1.00 |
| /lg-4 | BMA | 2% ammonium perchlorate + 0.3% NC | 80 | 0.98 | 1.00 |
| 1B/B-1 | BMA | none (control) | 60 | 0.62 | 0.91 |
| 1B/B-1 | BMA | none (control) | 80 | 0.23 | 0.34 |
| 1E/B-3 | CBP | 2% $KNO_3$ + 0.3% NC | 60 | 0.67 | 0.95 |
| /lg-2 | CBP | 2% $KNO_3$ + 0.3% NC | 80 | 0.62 | 0.93 |
| 1F/B-3 | CBP | 2% potassium perchlorate + 0.3% | 60 | 0.85 | 0.98 |
| /lg-3 | CBP | 2% potassium perchlorate + 0.3% | 80 | 0.75 | 0.96 |
| 1F/B-3 | CBP | 2% ammonium perchlorate + 0.3% NC | 60 | 0.94 | 0.98 |
| /lg-4 | CBP | 2% ammonium perchlorate + 0.3% NC | 80 | 0.73 | 0.95 |
| 1B/B-2 | CBP | None (control) | 60 | 0.41 | 0.73 |
| | CBP | None (control) | 80 | 0.38 | 0.37 |

[b]Ratio of average property value at screen mesh shown to average value with 44 mesh screening.

What is claimed is:

1. A method for improving ignition properties of deterrent-coated smokeless propellant comprising: applying to said deterrent-coated propellant an effective amount of an igniter component in the form of a composition comprising (a) nitrocellulose (NC) base, (b) liquid carrier, (c) up to about 10% by dry propellant weight, of at least one inorganic oxidizer component, and (d) a surfactant; and finishing the igniter composition-treated deterrent-coated propellant to obtain an overcoat comprising an igniter component on said propellant.

2. The method of claim 1 wherein the inorganic oxidizer component consists of about 2%–6% by propellant weight of at least one member selected from the group consisting of potassium nitrate, sodium nitrate, ammonium nitrate, potassium perchlorate, and ammonium perchlorate.

3. The method of claim 1 wherein the deterrent-coated propellant is a double base smokeless nitrocellulose propellant coated with pinewood resin substantially insoluble in aliphatic hydrocarbon and having a softening point less than about 90° C.

4. The method of claim 2 wherein said propellant composition is a single base smokeless nitrocellulose propellant coated with a pinewood resin insoluble in aliphatic hydrocarbon and having a softening point less than about 90° C.

5. A smokeless propellant obtained in accordance with the method of claim 1.

6. A smokeless propellant obtained in accordance with the method of claim 2.

7. A smokeless propellant obtained in accordance with the method of claim 3.

8. A smokeless propellant obtained in accordance with the method of claim 4.

9. An igniter component for deterrent-coated nitrocellulose-based smokeless propellant, said component comprising in combination, (A) about 20 wt %–90 wt % nitrocellulose (NC) base;

(B) surfactant up to about an amount sufficient to initially emulsify said nitrocellulose base; and, (C) sufficient inorganic oxidizer to obtain about 0.1%–10% by dry propellant weight.

10. The igniter component of claim 9 wherein the inorganic oxidizer is at least one member selected from the group consisting of potassium nitrate, sodium nitrate, ammonium nitrate, potassium perchlorate, and ammonium perchlorate.

11. The igniter component of claim 10 containing sufficient oxidizer to obtain about 2%–6% by dry propellant weight.

12. Deterrent coated smokeless propellant overcoated with the igniter component of claim 9.

13. Deterrent coated smokeless propellant overcoated with the igniter component of claim 10.

* * * * *